US008270555B2

(12) United States Patent
Hannah et al.

(10) Patent No.: US 8,270,555 B2
(45) Date of Patent: Sep. 18, 2012

(54) SYSTEMS AND METHODS FOR STORAGE AND PROCESSING OF RADIOISOTOPES

(75) Inventors: John Hannah, Wilmington, NC (US); William Earl Russell, II, Wilmington, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 981 days.

(21) Appl. No.: 12/113,314

(22) Filed: May 1, 2008

(65) Prior Publication Data

US 2009/0272920 A1 Nov. 5, 2009

(51) Int. Cl.
*G21C 19/00* (2006.01)

(52) U.S. Cl. ..... 376/272; 376/264

(58) Field of Classification Search ..... 376/272, 376/264; 250/505.1
See application file for complete search history.

(56) References Cited

U.S. PATENT DOCUMENTS 3,940,318 A 2/1976 Arino et al.
3,998,691 A 12/1976 Shikata et al.
4,196,047 A 4/1980 Mitchem et al.
4,284,472 A 8/1981 Pomares et al.
4,295,401 A * 10/1981 Mullett ..... 83/864
4,364,899 A * 12/1982 Aubert et al. ..... 376/264
4,462,956 A 7/1984 Boiron et al.
4,475,948 A 10/1984 Cawley et al.
4,493,813 A 1/1985 Loriot et al.
4,532,102 A 7/1985 Cawley
4,597,936 A 7/1986 Kaae
4,617,985 A 10/1986 Triggs et al.
4,663,111 A 5/1987 Kim et al.
4,729,903 A 3/1988 McGovern et al.
4,782,231 A 11/1988 Svoboda et al.
4,859,431 A 8/1989 Ehrhardt
5,053,186 A 10/1991 Vanderheyden et al.
5,145,636 A 9/1992 Vanderhevden et al.
5,271,051 A * 12/1993 Corletti et al. ..... 376/298
5,291,532 A * 3/1994 Townsend et al. ..... 376/269
5,355,394 A 10/1994 Van Geel et al.
5,400,375 A 3/1995 Suzuki et al.
5,513,226 A 4/1996 Baxter et al.
5,596,611 A 1/1997 Ball
5,615,238 A 3/1997 Wiencek et al.
5,633,900 A 5/1997 Hassal
5,682,409 A 10/1997 Caine
5,758,254 A 5/1998 Kawamura et al.
5,867,546 A 2/1999 Hassal
5,871,708 A 2/1999 Park et al.
5,910,971 A 6/1999 Ponomarev-Stepnoy et al.
6,056,929 A 5/2000 Hassal
6,160,862 A 12/2000 Wiencek et al.
6,192,095 B1 2/2001 Sekine et al.
6,233,299 B1 5/2001 Wakabayashi
6,456,680 B1 9/2002 Abalin et al.
(Continued)

*Primary Examiner* — Ricardo Palabrica
(74) *Attorney, Agent, or Firm* — Harness, Dickey & Pierce, P.L.C.

(57) ABSTRACT

In various embodiments, the system comprises a system for storing radioactive material, wherein the system includes a storage pool for storing a plurality of radioactive objects submersed in a radiation shielding and cooling liquid. The system additionally includes an assembly building located above the storage pool for constructing one or more radioactive articles using the radioactive objects transferred from the storage pool. Furthermore, the system includes at least one transfer shaft connecting the storage pool and the assembly building. The transfer shaft(s) are used for transferring the radioactive objects directly from within the storage pool to an interior of the assembly building and directly from the interior of the assembly building into the storage pool.

20 Claims, 8 Drawing Sheets

U.S. PATENT DOCUMENTS

| | | | |
|---|---|---|---|
| 6,678,344 | B2 | 1/2004 | O'Leary et al. |
| 6,751,280 | B2 | 6/2004 | Mirzadeh et al. |
| 6,804,319 | B1 | 10/2004 | Mirzadeh et al. |
| 6,895,064 | B2 | 5/2005 | Ritter |
| 6,896,716 | B1 | 5/2005 | Jones, Jr. |
| 7,157,061 | B2 | 1/2007 | Meikrantz et al. |
| 7,235,216 | B2 | 6/2007 | Kiselev et al. |
| 2002/0034275 | A1 | 3/2002 | Abalin et al. |
| 2003/0012325 | A1 | 1/2003 | Kernert et al. |
| 2003/0016775 | A1 | 1/2003 | Jamriska, Sr. et al. |
| 2003/0103896 | A1 | 6/2003 | Smith |
| 2003/0179844 | A1 | 9/2003 | Filippone |
| 2004/0091421 | A1 | 5/2004 | Aston et al. |
| 2004/0105520 | A1 | 6/2004 | Carter |
| 2004/0196942 | A1 | 10/2004 | Mirzadeh et al. |
| 2004/0196943 | A1 | 10/2004 | Di Caprio |
| 2005/0105666 | A1 | 5/2005 | Mirzadeh et al. |
| 2005/0118098 | A1 | 6/2005 | Vincent et al. |
| 2006/0062342 | A1 | 3/2006 | Gonzalez Lepera et al. |
| 2006/0126774 | A1 | 6/2006 | Kim et al. |
| 2007/0133731 | A1 | 6/2007 | Fawcett et al. |
| 2007/0133734 | A1 | 6/2007 | Fawcett et al. |
| 2007/0297554 | A1 | 12/2007 | Lavie et al. |
| 2008/0031811 | A1 | 2/2008 | Ryu et al. |
| 2008/0076957 | A1 | 3/2008 | Adelman |

* cited by examiner

SYSTEMS AND METHODS FOR STORAGE AND PROCESSING OF RADIOISOTOPES

FIELD

The present teachings relate to systems and methods for the storage and processing of radioisotopes.

BACKGROUND

The statements in this section merely provide background information related to the present disclosure and may not constitute prior art.

Large-scale production of radioisotopes is now possible, necessitating safe storage of large quantities of the irradiated materials. Generally, the radioisotopes comprise pellets, wires, disks, etc., of a desired isotopic material, e.g., cobalt, that has been irradiated to have a desired radioactivity. In many instances, these radioisotopes will be used to construct, or assemble, many different customer specified source capsules having many different desired activity profiles, i.e., many different containers having one or more radioisotopes sealed therein to provide various desired activity profiles. The operations required for such encapsulation must be done in a shielded facility and require large amounts of repetitive work to be performed.

Traditionally, an inventory of various isotopes is stored in a plurality of storage structures. Particularly, rods or tubes in which the radioisotopes are produced are stored in a plurality of radioactive shielded storage structures. To assemble, or construct, a source capsule having a particular customer requested activity profile, radioisotopes of various radioactivity, from various storage structures, are placed in radioactive shielded casks, removed from the respective storage structures. The casks are then transported to a separate assembly facility, commonly referred to as a 'hot cell'. Once the various radioisotopes have been transported to the hot cell, the casks will be opened to access the respective radioisotopes. The desired amount of each respective radioisotope will be then removed and sealed in a capsule, e.g., a stainless steel container, to provide a source capsule having the desired activity profile. The unused radioisotopes will then be returned to the casks. The casks will then be removed from the hot cell and transported back to the respective storage structures.

Thus, the process of loading the various radioisotopes stored in the various storage structures in casks, transporting the casks to the hot cell, opening the casks to access the radioisotopes, assembling the source capsules, repacking the casks and returning the casks to the storage structures is a cumbersome and time consuming task.

SUMMARY

In various embodiments, a system for storing radioactive material is provided, wherein the system includes a storage pool for storing a plurality of radioactive objects submersed in a radiation shielding and cooling liquid. The system additionally includes an assembly building located above the storage pool for constructing one or more radioactive article using the radioactive objects transferred from the storage pool. Furthermore, the system includes at least one transfer shaft connecting the storage pool and the assembly building. The transfer shaft(s) is/are used for transferring the radioactive objects directly from within the storage pool to an interior of the assembly building and directly from the interior of the assembly building into the storage pool.

In various other embodiments, a system for storing radioactive material is provided, wherein the system includes a storage pool disposed within and beneath a floor of the system. The storage pool is structured for storing a plurality of radioisotopes submersed in a radiation shielding and cooling liquid. The system additionally includes a capsule assembly building disposed on the system floor above the storage pool. The capsule assembly building can include an assembly chamber comprising a plurality of interior cells for constructing one or more radioactive capsules using radioisotopes transferred from the storage pool to the capsule assembly building. The system further includes at least one transfer shaft connecting the storage pool and the capsule assembly building to provide direct access to the storage pool from an interior of the capsule assembly building. Therefore, the transfer shaft(s) provide for transferring the radioisotopes from within the storage pool directly to the interior of the capsule assembly building and from the interior of the capsule assembly building directly into the storage pool.

In still other embodiments, a method for storing radioactive material is provided, wherein the method includes storing a plurality of radioisotopes submersed in a radiation shielding and cooling liquid within a storage pool, and transferring selected radioisotopes directly from within the storage pool to an interior of an assembly chamber of an assembly building. The assembly building can be located above the storage pool. The selected radioisotopes are transferred from within the storage pool directly to the interior of an assembly chamber via at least one transfer shaft connecting the storage pool and the assembly building. The method additionally includes constructing one or more radioactive capsules within the assembly chamber using the radioisotopes transferred from the storage pool. The method further includes transferring the selected radioisotopes not used to construct the one or more radioactive capsules directly from the interior of the assembly chamber into the storage pool using the at least one transfer shaft.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

Figure 1:
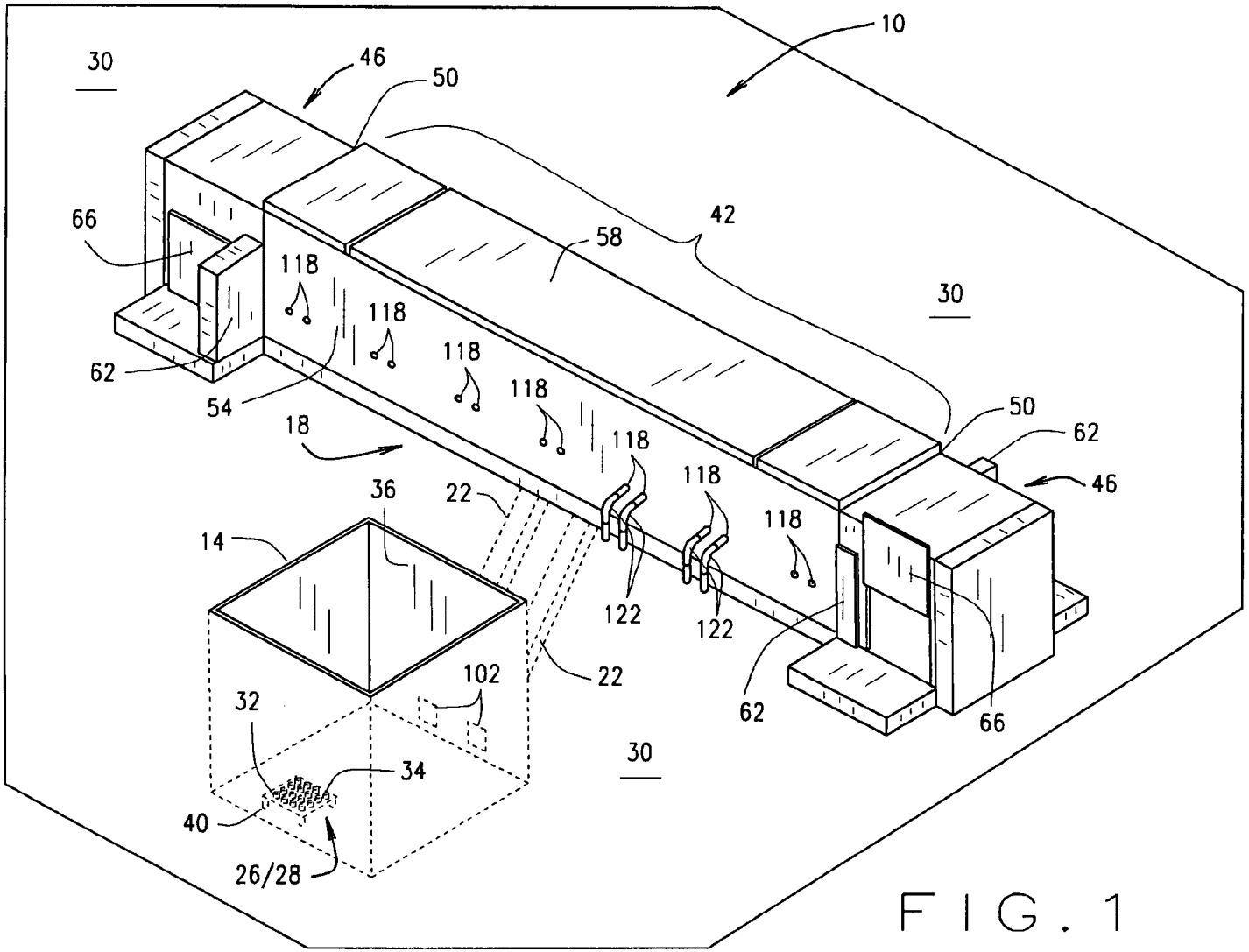
FIG. 1 is an isometric view of a facility for storing radioactive material, in accordance with various embodiments of the present disclosure.

The following description is merely exemplary in nature and is in no way intended to limit the present teachings, application, or uses. Throughout this specification, like reference numerals will be used to refer to like elements.

Figure 2:
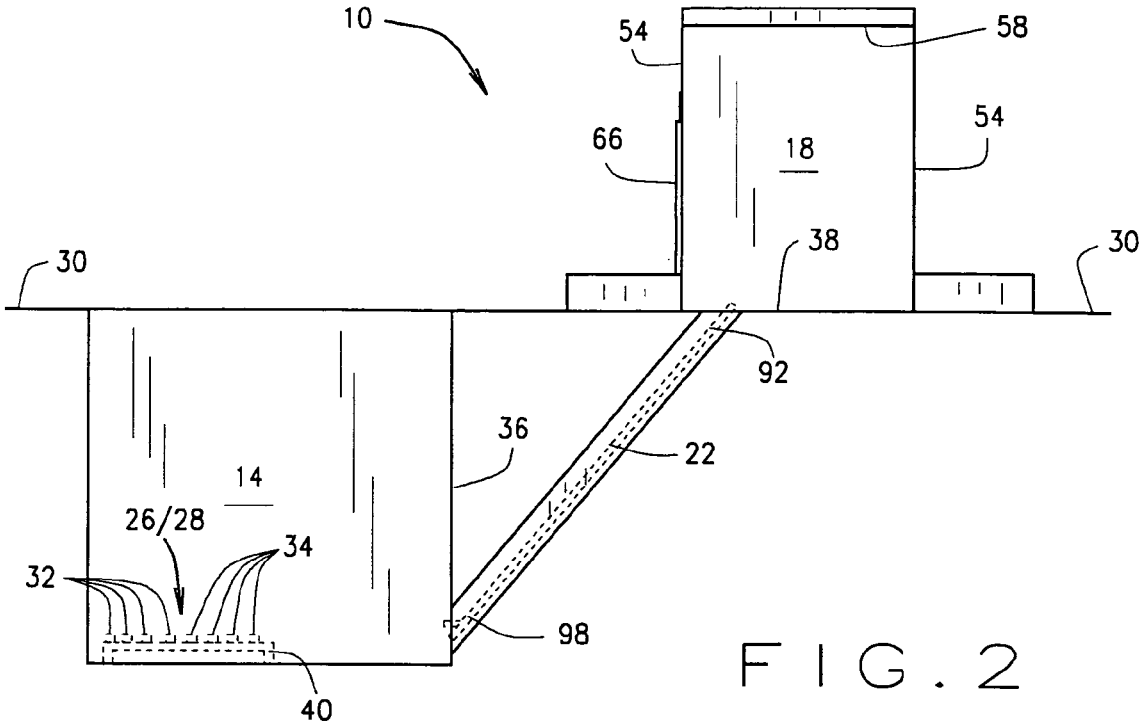
FIG. 2 is a side view of the radioactive material storing facility shown in FIG. 1, in accordance with various embodiments of the present disclosure.

FIGS. 1 and 2 illustrate a facility 10 structured and operable to provide safe storage of radioactive materials, such as radioisotopes, and also provide quick, convenient and safe access to the stored radioactive material for processing of the radioactive material into various useful items and/or products. For example, in various embodiments, the facility 10 includes a storage pool 14 connected to an assembly building 18 via at least one radioactive material transfer shaft 22. Although the facility 10 can include one or more transfer shafts 22 connecting the storage pool 14 with the assembly building 18, for consistency and simplicity, the facility 10 will be described herein to include a pair of redundant transfer shafts 22.

The storage pool 14 is structured to be filled with a radiation shielding and cooling liquid, e.g., water, such that a plurality of radioactive objects 26 and/or a plurality of radioactive articles 28 constructed from the radioactive objects 26 can be submerged and stored therein. The radioactive articles 28 and/or radioactive objects 26 can comprise any radioactive material such as Cobalt 60 (Co-60), iridium, nickel, etc. In various embodiments, the radiation shielding and cooling liquid can be circulated through a chiller (not shown) to cool the liquid in order to provide a desired cooling for the stored radioactive objects 26 and/or articles 28.

The cooling liquid captures decay heat emanated from the radioactive objects 26 and/or radioactive articles 28 submerged within the storage pool 14. The amount of heat needing to be dissipated is dependent on the curie content of the storage pool 14 and the specific radioactive objects 26 and/or radioactive articles 28 being stored. As an example, if the storage pool 14 were near its capacity for storage of Cobalt 60 (Co-60) radioactive objects 26 and/or radioactive articles 28, generating 0.015 Wafts/Ci, then the cooling liquid (optionally circulated through a chiller) can be utilized to maintain radioactive objects 26 and/or radioactive articles 28 at approximately 100° F. In alternative implementations the cooling liquid (optionally circulated through a chiller) can be utilized to maintain radioactive objects 26 and/or radioactive articles 28 at approximately 100° F. to 200° F.

Additionally, it is envisioned that the storage pool 14 can be sized to hold a very large quantity, e.g., thousands, of the radioactive objects 26 and/or articles 28. The assembly building 18 is constructed to be a radiation shielding and containment structure suitable for safely housing radioactive objects 26 and/or articles 28 transferred directly from the storage pool 14 to an interior of the assembly building 18, via the transfer shafts 22. As described further below, in operation, to construct the radioactive article(s) 28, radioactive objects 26 are selected from within the storage pool 14 and transferred directly to an interior of the assembly building 18 where the radioactive objects 26 are used to construct one or more radioactive articles 28 for a particular use.

For example, in various embodiments, the radioactive objects 26 can comprise radioactive rods 32 containing various radioisotopes having various radioactive intensities and the radioactive articles 28 can comprise source capsules 34 that have been constructed within the assembly building 18 to have desired activity profiles and returned to the storage pools 14 for safe storage. Particularly, a large number of radioactive rods 32 and/or source capsules 34 can be stored in a plurality of racks 40 within the storage pool 14. To assemble, or construct, the source capsules 34, one or more rods 32 containing particular radioisotopes can be transferred directly from the storage pool 14 to the interior of a radioactive containing assembly chamber 42 of the assembly building 18, via the transfer shafts 22. Once the rods 32 have been transferred into the assembly chamber 42, the rods 32 can be opened to access the respective radioisotopes. The radioisotopes can then be used to construct one or more radioactive source capsules 34 having desired activity profiles. The source capsules 34 can then either be returned to the storage pool 14 for storage or transported to a desired location, e.g., a medical facility for use in medical imaging and/or treatment. In such embodiments, the assembly can also be referred to as the capsule assembly chamber 42.

In various embodiments, the assembly building 18 is located above, or higher, and in close proximity to, the storage pool 14 such that the radioactive objects 26 and/or articles have a relatively short distance to travel through the transfer shafts 22 when being transferred between storage pool 14 and the assembly building 18. For example, in various embodiments, as illustrated in FIGS. 1 and 2, the storage pool 14 can be disposed within and beneath a floor 30 of the facility 10 and the assembly building 18 can be disposed on the facility floor 30 above and in close proximity to the storage pool 14. Accordingly, the transfer shafts 22 are disposed within and beneath the floor 30 and extend between a bottom portion of a side wall 36 of the storage pool 14 and a floor 38 of the assembly chamber 42. Alternatively, in various other embodiments, the storage pool 14 can be disposed within and partially beneath the floor 30 or built to stand on or above the floor 30. In such embodiments, the assembly building 18 would be supported above the floor 30 and above the top of the storage pool 14, having the transfer shafts 22 extending there between.

Figure 3:
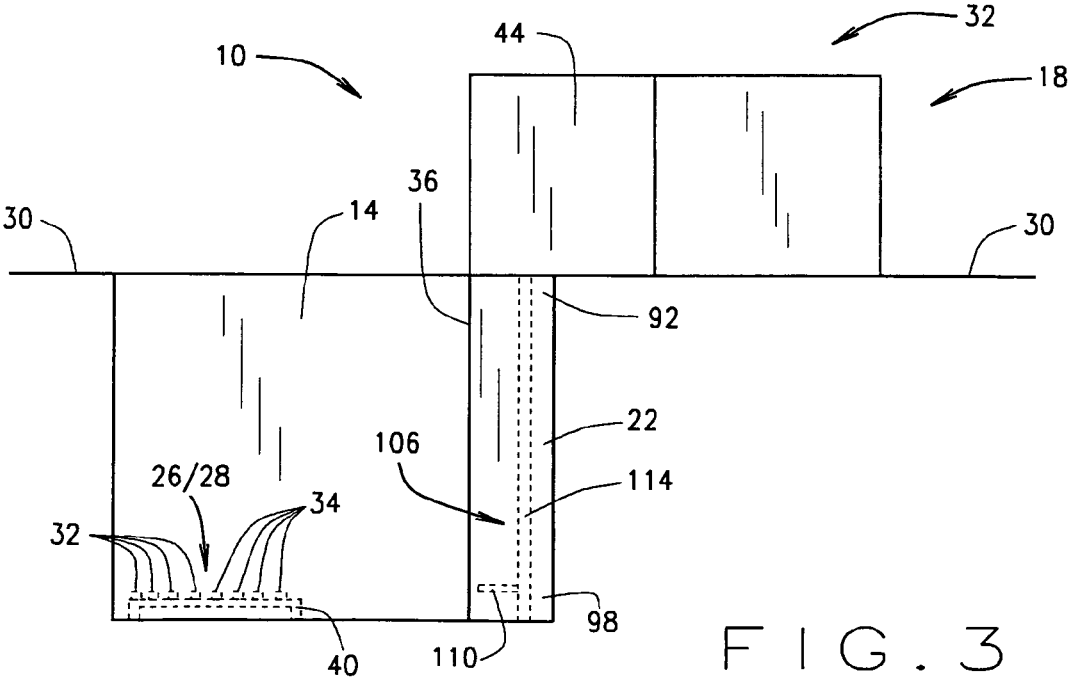
FIG. 3 is a side view of the radioactive material storing facility shown in FIG. 1, in accordance with various other embodiments of the present disclosure.

Additionally, in various embodiments, as illustrated in FIG. 3, the assembly chamber 42 can include an annex 44 extending from the assembly chamber 42 toward the storage pool 14. Particularly, the annex 44 is located substantially above, or over, the storage pool side wall 36 such that the transfer shafts 22 have a substantially vertical orientation between the storage pool 14 and the annex 44.

Figure 4:
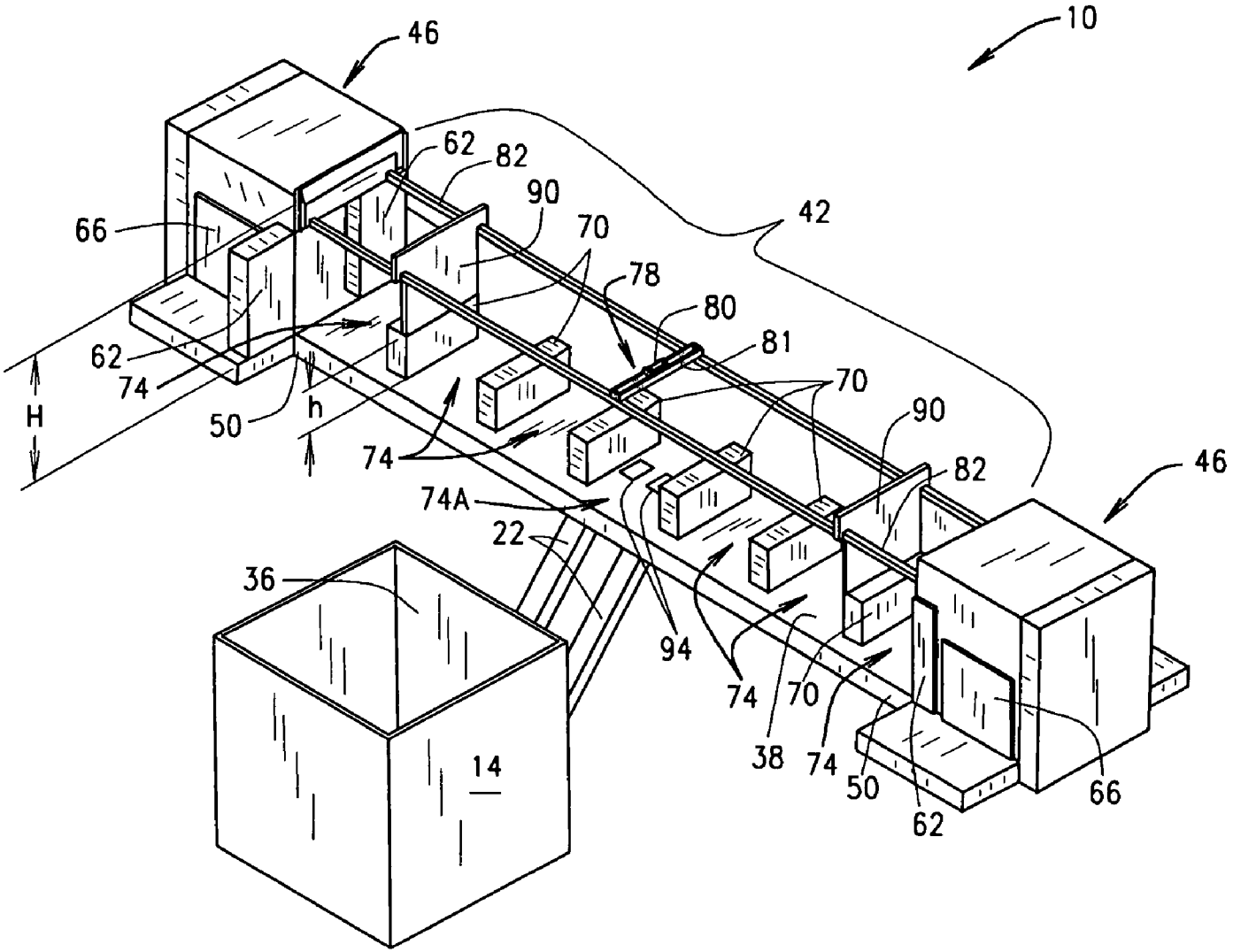
FIG. 4 is an isometric view of an assembly building of the radioactive material storing facility shown in FIG. 1, having radiation shielding and containment walls and ceiling removed to illustrate a plurality of interior assembly cells, in accordance with various embodiments of the present disclosure.

Referring to FIGS. 1 and 4, in various embodiments, the assembly facility 18 generally includes the assembly chamber 42 and at least one interlock 46 connected to at least one of opposing ends 50 of the assembly chamber 42. The assembly chamber 42 includes opposing radiation shielding and containment side walls 54 that each joins a radiation shielding and containment ceiling 58. The radiation shielding and containment side walls 54 and ceiling 58 provide a radiation containment environment within the interior of the assembly chamber 42 that contains radioactive radiation from the objects 26 and/or articles 28 transferred from the storage pool 14 within the assembly chamber 42. As shown in FIG. 4, each interlock 46 includes a radiation shielding and containment interlock door 62 operable to provide radiation containment within the interior of the assembly chamber 42 when in a 'Closed' position. When in an 'Opened' position, each radiation shielding and containment interlock door 62 allows ingress and egress to and from the interior of the assembly chamber 42 for removal of the assembled radioactive articles, e.g., radioactive source capsules 34. Each interlock 46 additionally includes at least one exterior access door 66 operable to allow access to an interior of the respective interlock 46 for disposition and/or removal of items, such as casks for transporting the assembled radioactive articles 28 from the assembly chamber 42.

Figure 5:
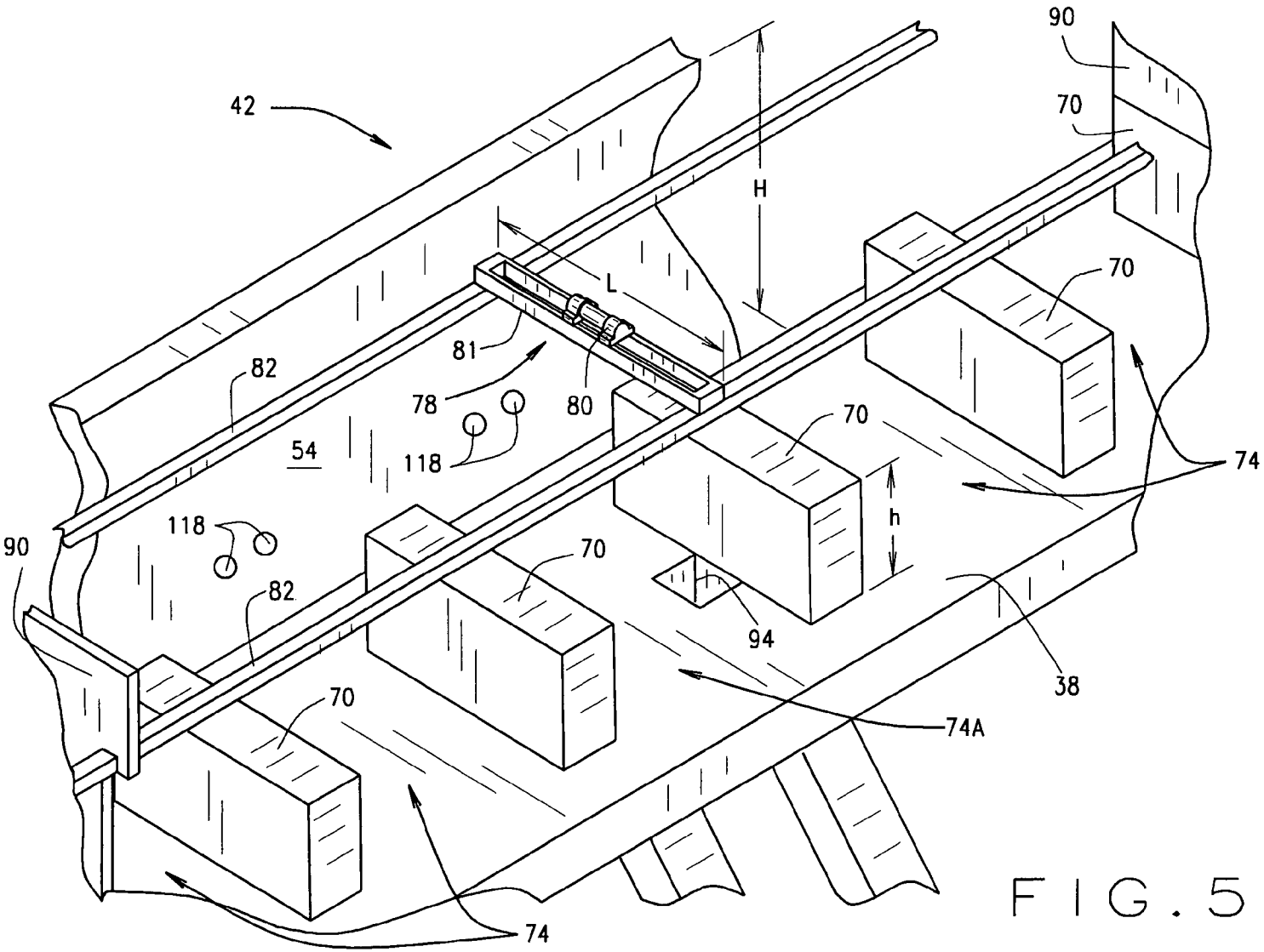
FIG. 5 is an isometric view of a portion of an interior of an assembly chamber of the assembly building of the radioactive material storing facility shown in FIG. 1, in accordance with various embodiments of the present disclosure.

Referring now to FIGS. 4 and 5, in various embodiments, the assembly chamber 42 is structured to include a plurality of radioactive shielding partitions 70 within the interior of the assembly chamber 42. The radioactive shielding partitions 70 form a plurality of interior assembly cells, or stations, 74 used for assembling, or constructing, the radioactive articles, e.g., radioactive source capsules 34. In various embodiments, a height h of each radioactive shielding partition 70 is only a portion of a height H of the assembly chamber interior. Additionally, it is envisioned that in various implementations, the radioactive shielding partitions 70 can be moveable, i.e., able to be relocated, within the assembly chamber 42 to form various size assembly cells 74. Additionally, the assembly chamber 42 can include an overhead crane device 78 structured and operable to be controllably movable from one end 50 of the assembly chamber 42 to the opposing end 50 along tandem tracks, or cables, 82 that extend from one end 50 of the assembly chamber 42 to the opposing end 50, e.g., extend between opposing interlocks 46. More particularly, the overhead crane device 78 includes a winch 80 that is controllably translatable along a length L of a frame 81 of the crane device 78. Thus, the crane device 78 is structured and operable to move radioactive objects 26 and assembled articles 28 over the radioactive shielding partitions 70 and between any of the various assembly cells 74, between any of the various assembly cells 74 and any of the interlocks 46, and between opposing interlocks 46.

Figure 6:
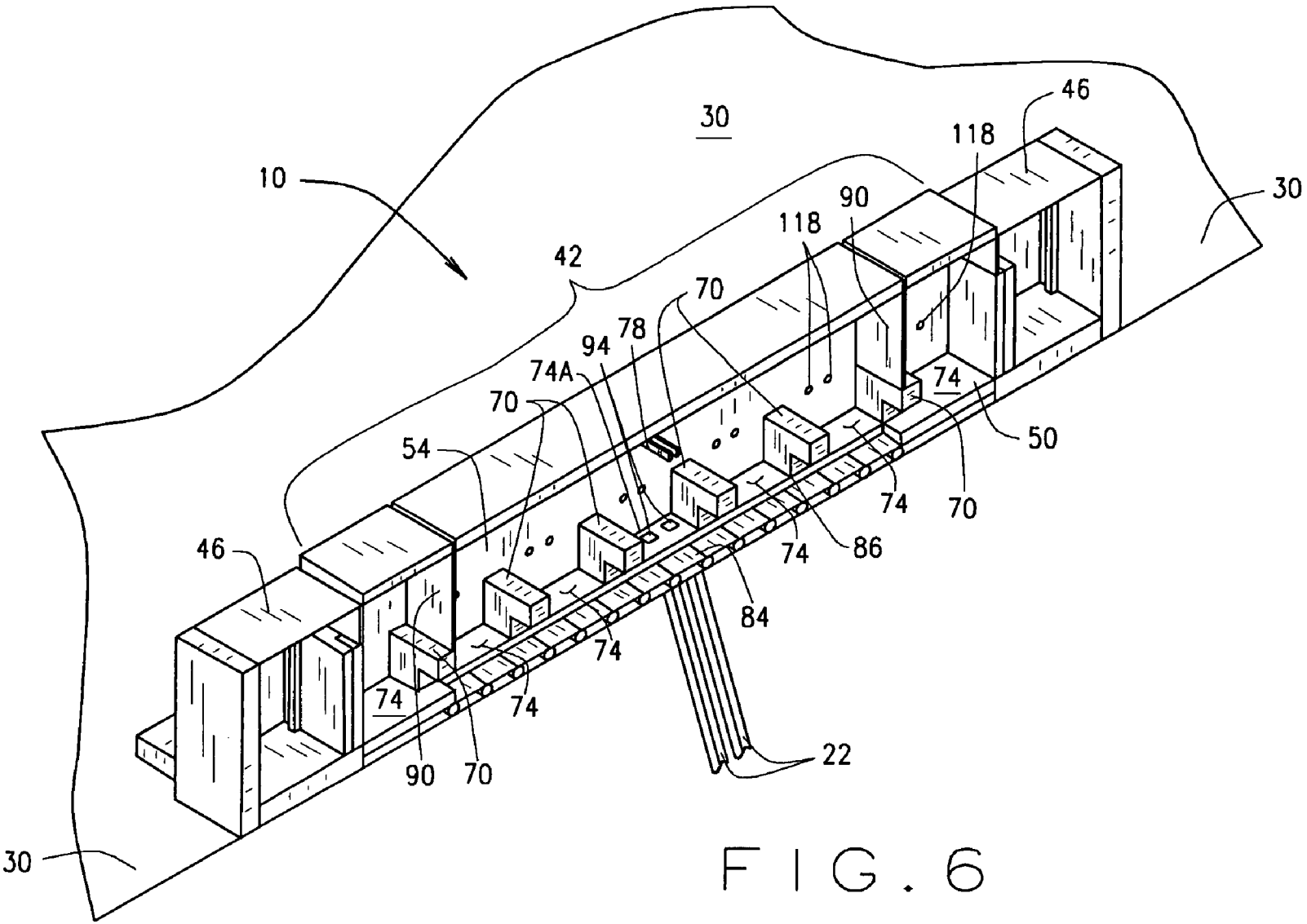
FIG. 6 is a cross-sectional view of the radioactive material storing facility shown in FIG. 1, illustrating an under-floor conveyor belt system, in accordance with various embodiments of the present disclosure.

Referring to FIGS. 4, 5 and 6, in various other embodiments, in addition to the overhead crane device 78, the assembly chamber 42 can include an under-floor conveyor belt system 84 located within and/or beneath the floor 38 of the assembly chamber 42. The under-floor conveyor belt system 84 can be constructed of any material suitably designed to be corrosion resistant. For example, in various embodiments, the under-floor conveyor belt system 84 can be constructed of stainless steel or similar materials. To provide access to the under-floor conveyor belt system 84, the assembly chamber floor 38 includes an opening 86 that extends longitudinally along the floor 38 under the assembly cells 74. The conveyor belt system 84 is located below the opening 86 and is structured and operable to controllably move the radioactive objects 26 and articles 28 between the various assembly cells 74 beneath the radioactive shielding partitions 70.

Referring again to FIGS. 4 and 5, in various embodiments, the assembly chamber 42 can include one or more movable divider panels 90 structured and functional to connect to, or mate with, the top of any of the radioactive shielding partitions 70. When connected to, or mated with, one of the radioactive shielding partitions 70, the respective movable divider panel 90 and radioactive shielding partition 70 forms a full length wall extending substantially from the floor 38 to the ceiling 58 and from the wall 54 to the wall 54 of the assembly chamber 42. In various embodiments, the divider panels 90 can be slideably supported by and suspended from the crane device tracks 82. Thus, the divider panels 90 can be moved along, i.e., slid along, the tracks 82 to position the respective divider panel 90 in contact with a top of a respective radioactive shielding partition 70. Subsequently, the respective divider panel 90 can be coupled with the respective radioactive shielding partition 70 via any suitable mating and/or connecting means. For example, the divider panels 90 radioactive shielding partitions 70 can be structured to mate in a 'tongue and groove' manner or by any other interlocking mating manner. Or, the respective divider panel 90 can be coupled with the respective radioactive shielding partition 70 using any suitable fastening means, such as nuts and bolts, locking pins, or any other suitable latching means.

In various implementations, the assembly cells 74 include at least one docking cell 74A, e.g., the centermost assembly cell 74, and at least one other assembly cell 74 for constructing the one or more radioactive articles therein. A disposition end 92 of each transfer shaft 22 (shown in FIG. 2) is connected to a respective aperture 94 in the floor 38 of the assembly chamber docking cell 74A. The docking cell apertures 94 provide an inlet to, and outlet from, the assembly chamber 42 for the radioactive objects 26 and/or articles 28 transferred directly to and from the storage pool 14. Similarly, a storage end 98 of each transfer shaft (shown in FIG. 2) is connected to a respective aperture 102 in the storage pool side wall 36 (shown in FIG. 1). The storage pool apertures 102 provide an inlet to, and outlet from, the storage pool 14 for the radioactive objects 26 and/or articles 28 transferred directly to and from the assembly chamber docking cell 74A. Thus, the radioactive objects 26 and/or articles 28 can be transferred directly from the storage pool 14 to the docking cell 74A, via the transfer shafts 22, the docking cell apertures 94 and the storage pool apertures 102.

Figure 7:
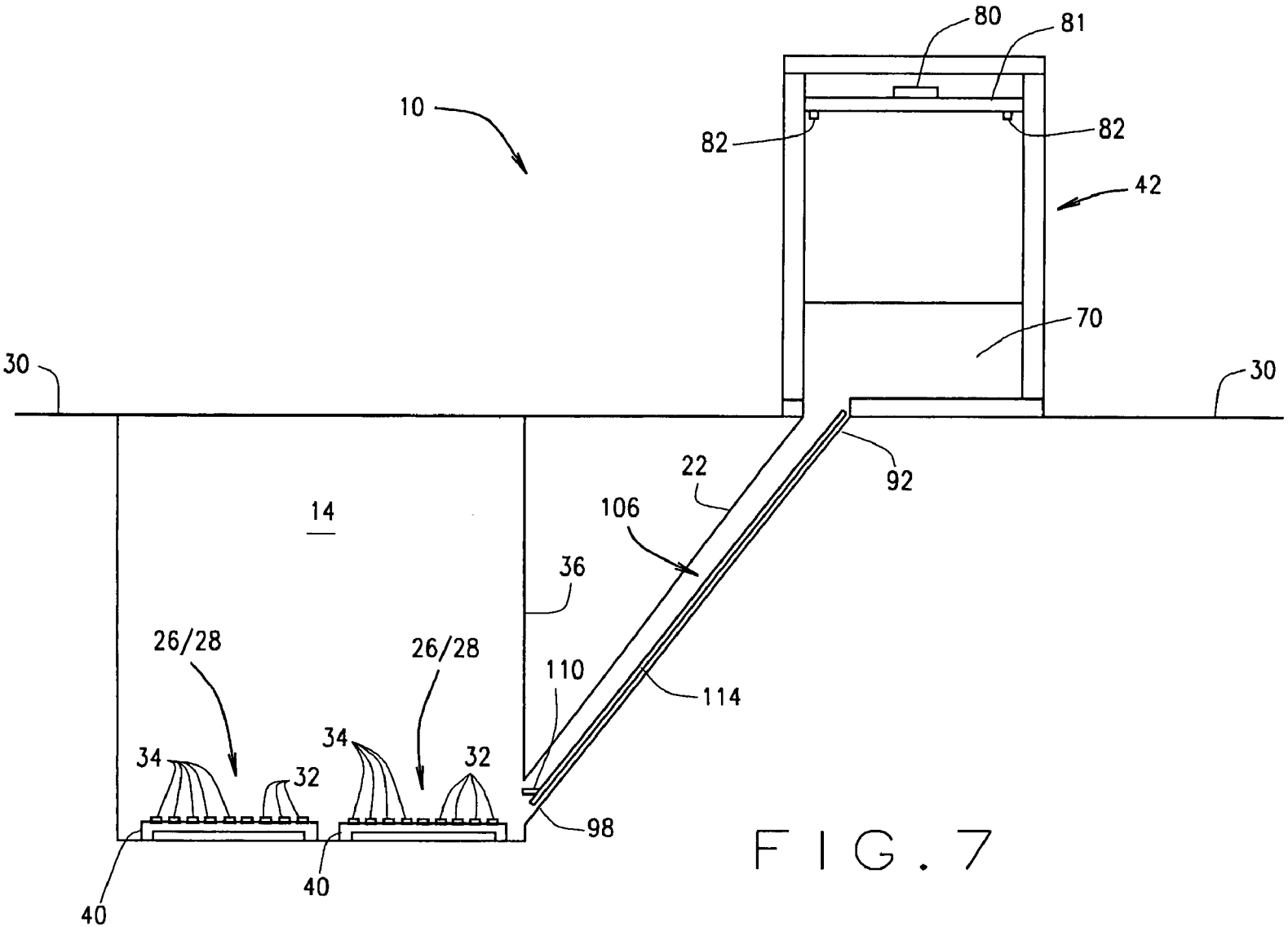
FIG. 7 is a cross-sectional view of the radioactive material storing facility shown in FIG. 1, illustrating an elevator system for transferring radioactive objects from a storage pool of the facility directly to the interior of the assembly chamber, in accordance with various embodiments of the present disclosure.
Figure 8:
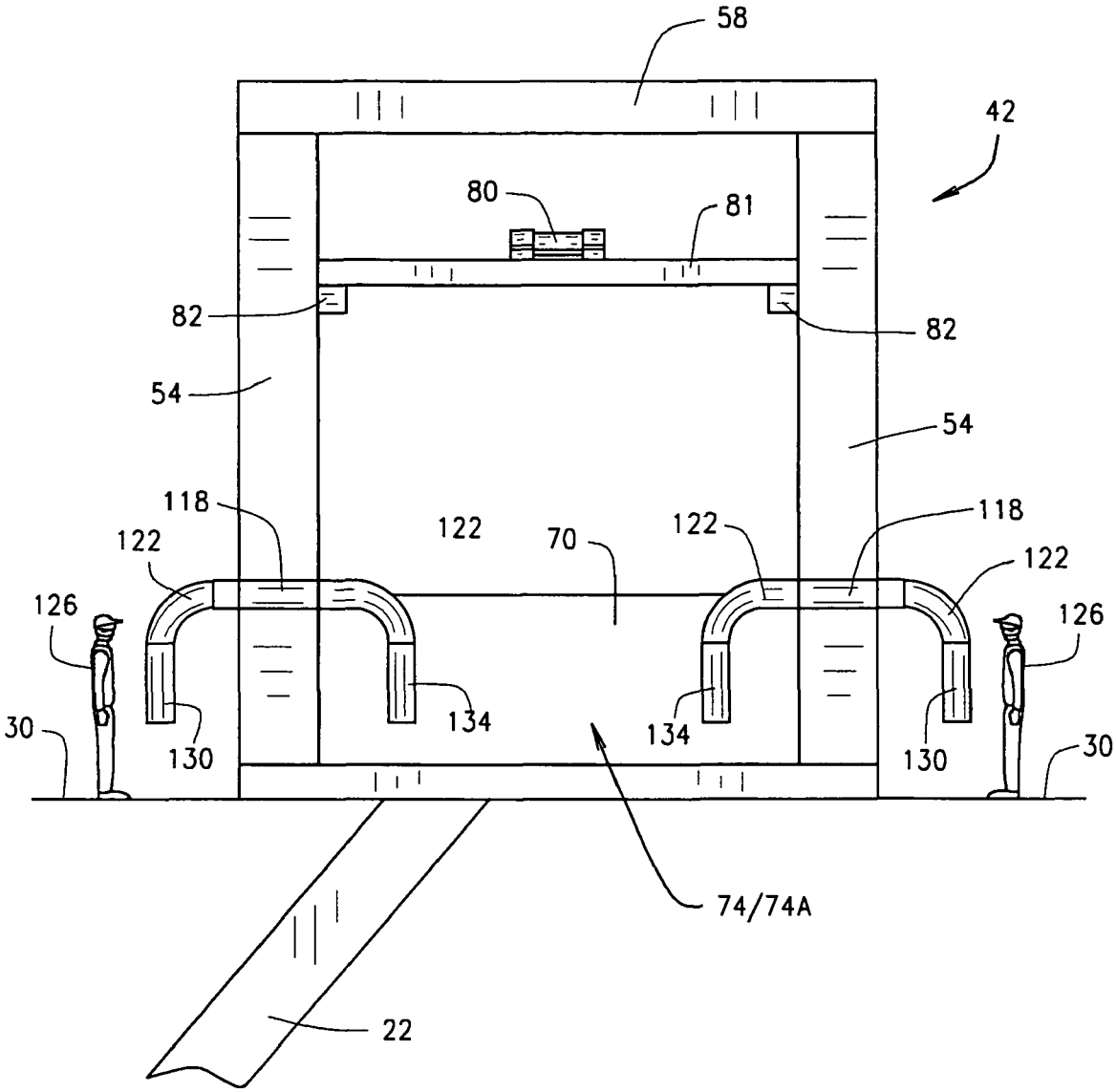
FIG. 8 is a cross-sectional view of the assembly chamber of the radioactive material storing facility shown in FIG. 1, illustrating a plurality of object manipulators located along, and extending through, each of opposing assembly chamber side walls, in accordance with various embodiments of the present disclosure.

Referring now to FIGS. 3 and 7, in various embodiments, each transfer shaft 22 includes an elevator system 106 structured and operable to transfer the radioactive objects 26 and/or articles 28, e.g., radioisotope rods 32 and/or radioactive source capsules 34, directly from the storage pool 14 to the interior of the assembly chamber 42 through the respective transfer shaft 22. In various implementations, the elevator system 106 is additionally structured and operable to transfer the radioactive objects 26 and/or articles 28, e.g., radioisotope rods 32 and/or radioactive source capsules 34, directly from the interior of the assembly chamber 42 to storage pool 14 through the respective transfer shaft 22. The elevator system 106 includes at least one tray 110 coupled to a conveyor 114 structured and operable to move the tray(s) 110 within the respective transfer shaft 22 directly between the storage pool 14 and the interior of the assembly chamber 42. The elevator system 106, including tray(s) 110 and a conveyor 114, can be constructed of any material suitably designed to be corrosion resistant. For example, in various embodiments, the elevator system 106, including tray(s) 110 and a conveyor 114, can be constructed of stainless steel or similar materials.

The conveyor 114 can be any system, device or mechanism suitable for conveying, i.e., transferring, moving or translating, the elevator system tray(s) 110, and any radioactive object 26 and/or article 28 placed thereon, along the interior length of the respective transfer shaft 22. For example, the conveyor 114 can be a conveyor-belt type system, a chain-and-sprocket type system, a cable-and-pulley type system, a threaded shaft type system, any combination thereof, or any other suitable conveying system.

Referring now to FIGS. 1, 5, 6 and 8, in various embodiments, the assembly chamber 42 includes a plurality of manipulator ports 118 spaced along and extending through each of the assembly chamber side walls 54. The assembly chamber 42 additionally includes a plurality of object manipulators 122 that are spaced along each assembly chamber side wall 54 and extend through each of the manipulator ports 118. The object manipulators 122 may be robotic arms configured to articulate in designed fashion to construct a radioactive article 28. To this end, respective robotic arms may be with a tool such as a grasping claw, welder, screwdrivers, etc. for constructing radioactive article 28.

As will be appreciated, the object manipulators 122 are controllable by facility personnel, e.g., operators 126 (FIG. 8), from the exterior, i.e., outside, of the assembly chamber 42. More specifically, the operators 126 operate controls (not shown) included at a proximal end 130 of each object manipulator 122 that protrudes, or extends, externally from the respective assembly chamber side wall 54. Operation of the controls by the operators 126 controls movement and operation of a distal end 134 of each respective object manipulator 122 that protrudes, or extends, into the interior of the assembly chamber 42. Particularly, the distal end 134 of each object manipulator 122 extends into a respective assembly cell 74/74A to manipulate radioactive objects 26 and/or articles 28 within the assembly cells 74/74A. Accordingly, to move the radioactive objects 26, e.g., radioisotope rods 32, between and within the assembly cells 74/74A and to assemble/construct the radioactive articles 28, e.g., radioactive source capsules 34, an operator 126 controls the movement and actions of the object manipulator distal ends 134 inside the assembly chamber 42 by manipulating the controls at the object manipulator proximal ends 130. In various embodiments, the assembly chamber 42 includes one or more object manipulators 122 for each assembly cell 74/74A. Accordingly, a plurality of radioactive articles 28, e.g., radioactive source capsules 34, can be assembled substantially simultaneously utilizing the plurality of assembly cells 74/74A and the respective corresponding object manipulators 122

In operation, to assemble, or construct, one or more radioactive articles 28, one or more of the plurality of radioactive objects 26, e.g., radioisotope rods 32, stored in the storage pool 14 is/are selected, removed from the respective one of the plurality of racks 40, and moved to one of the storage pool side wall apertures 102. The radioactive object(s) 26 is/are selected based on particular desired characteristics of the particular object(s) 26, i.e., size, material, isotope, radioactivity, etc. Once the selected radioactive object(s) 26 have been moved to the storage pool side wall apertures 102, the radioactive object(s) 26 is/are placed on the elevator system tray 110 for transfer directly to the assembly chamber interior docking cell 74A.

Any suitable means can be employed to remove the selected radioactive object(s) 26 from the respective rack(s) 40, move the selected radioactive object(s) 26 to one of the storage pool side wall apertures 102 and place the selected radioactive object(s) 26 on the elevator system tray 110. For example, robotic devices, mechanisms, assemblies or systems (not shown) can be utilized to select the radioactive object(s) 26, move them to one of the storage pool side wall apertures 102 and place them on the elevator system tray 110. Or, alternatively, long mechanical grasping poles can be disposed into the storage pool and hand manipulated by facility personnel from the facility floor 30 to select the radioactive object(s) 26, move them to one of the storage pool side wall apertures 102 and place them on the elevator system tray 110.

After the selected radioactive object(s) 26 have been placed on the elevator system tray 110, the elevator system conveyor 114 is operated to transfer the selected radioactive object(s) 26 directly from the storage pool 14, through the respective transfer shaft 22 directly into the interior of the assembly chamber 42, i.e., directly into the docking cell 74A. The object manipulators 122 and/or the overhead crane device 78 and/or the under-floor conveyor system 84 can then be operated to manipulate the transferred radioactive object(s) 26 and move them from the docking cell 74A to one or more of the various other assembly cells 74. Once the radioactive object (s) 26 have been delivered to the one or more assembly cells 74, the facility personnel can operate the object manipulators 122 to assemble/construct, the radioactive articles, e.g., radioactive source capsules 34. The object manipulators 122 can also be utilized to place or package the assembled/constructed radioactive articles in shielded containers or casks. The overhead crane device 78 can then be operated to move the packaged radioactive articles into one of the interlocks 46 from which the packaged radioactive articles can be safely removed for delivery to a selected location.

Subsequently, the object manipulators 122 and/or the overhead crane device 78 and/or the under-floor conveyor system 84 can then be operated to manipulate the unused radioactive object(s) 26 and move them from the one or more assembly cells 74 to the docking cell 74A for return to the storage pool 14. The unused radioactive object(s) 26 can then be placed into one of the docking cell floor apertures 94 and onto a respective elevator system tray 110. The elevator system conveyor 114 is then operated to transfer the unused radioactive object(s) 26 directly from the interior of the assembly chamber 42, i.e., directly from the docking cell 74A, through the respective transfer shaft 22 and directly to the respective storage pool side wall aperture 102. The returned unused radioactive object(s) 26 can then be returned to the proper rack 40 submersed within the shielding and cooling liquid of the storage pool 14.

Figure 9:
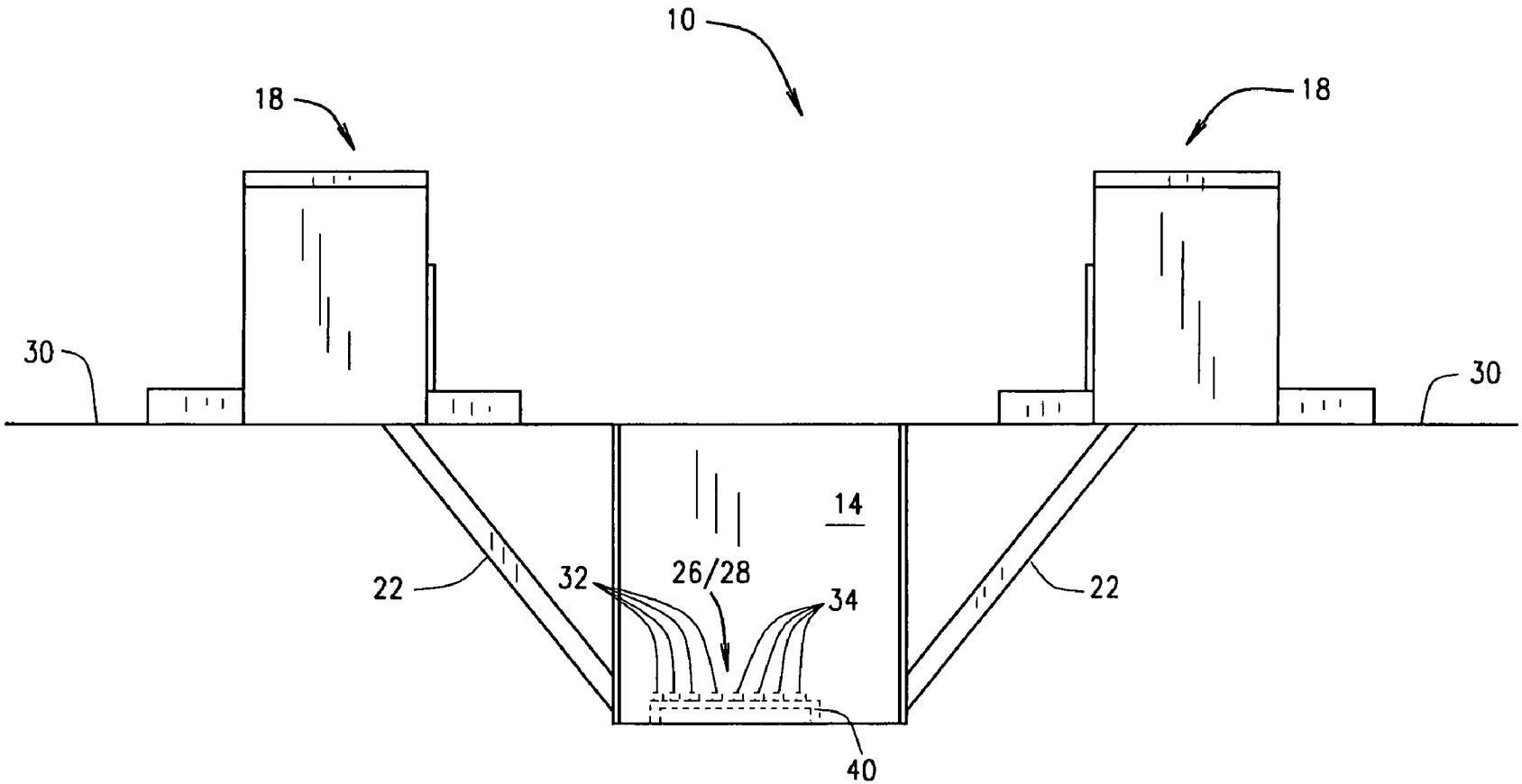
FIG. 9 is side view of the radioactive material storing facility shown in FIG. 1, including a plurality of assembly buildings that have access to the storage pool, in accordance with various embodiments of the present disclosure.

Referring now to FIG. 9, in various embodiments, the facility 10 can include two or more assembly buildings 18 coupled to a single storage pool 14 via respective corresponding transfer shafts 22. Accordingly, two or more assembly buildings 18 can have direct access to the single storage pool 14. More particularly, selected radioactive objects 26, e.g., the radioactive rods 34, stored within the storage pool can be simultaneously or concurrently transferred directly to any of the assembly buildings 18, via the respective corresponding transfer shafts 22, to simultaneously or concurrently assemble a plurality of radioactive articles 28, e.g., radioactive source capsules 34, as described above.

It should be understood that spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A system for storing radioactive material, said system comprising:

a storage pool for storing a plurality of radioactive objects submersed in a radiation shielding and cooling liquid;

an assembly building located above the storage pool for constructing one or more radioactive articles using the radioactive objects transferred from the storage pool, the assembly building including an assembly chamber including a plurality of interior cells and a plurality of radioactive shielding partitions such that each of the plurality of radioactive shielding partitions is between adjacent cells, the cells including a docking cell having a disposition end of each transfer shaft connected thereto, and at least one assembly cell for constructing the one or more radioactive article therein; and at least one transfer shaft connecting the storage pool and the assembly building for transferring the radioactive objects from within the storage pool to an interior of the assembly building and from the interior of the assembly building into the storage pool, the at least one transfer shaft connected to a floor of the assembly building.

2. The system of claim 1, wherein each transfer shaft comprises an elevator system operable to convey the radioactive objects from within the storage pool to an interior of the assembly building and from the interior of the assembly building into the storage pool.

3. The system of claim 1, wherein the shielding partitions are movable within the assembly building.

4. The system of claim 1, wherein the assembly building comprises at least one of a first interlock connected to a first end of the assembly chamber and a second interlock connected to an opposing second end of the assembly chamber.

5. The system of claim 4, wherein the assembly building further comprises a crane device within the interior of the assembly chamber operable to move the radioactive objects over the shielding partitions between the plurality of cells, and between the plurality of cells and the at least one interlock.

6. The system of claim 4, wherein the assembly building further comprises a conveyor system within or beneath a floor of the assembly chamber operable to move the radioactive objects beneath the shielding partitions between the plurality of cells and between the plurality of cells and the at least one interlock.

7. The system of claim 1, wherein at least one cell of the plurality of interior cells has opposing exterior walls, each of the opposing exterior walls of the at least one cell comprise at least one object manipulator opening that extends through the respective exterior wall, each object manipulator opening structured to allow access of a respective object manipulator to an interior of the cell, each object manipulator controllable from outside of the assembly chamber and operable to manipulate the radioactive objects within each of the cells to assemble the one or more radioactive articles.

8. The system of claim 1, further comprising a second assembly building located above the storage pool and connected with the storage pool via at least one second transfer shaft for constructing one or more radioactive article using the radioactive objects transferred from the storage pool via the at least one second transfer shaft.

9. A system for storing radioactive material, said system comprising:

a storage pool disposed within and beneath a floor of the system, the storage pool for storing a plurality of radioisotopes submersed in a radiation shielding and cooling liquid;

a capsule assembly building disposed on the system floor above the storage pool, the capsule assembly building comprising an assembly chamber including a plurality of interior cells for constructing one or more radioactive capsules using radioisotopes transferred from the storage pool to the capsule assembly building, the assembly chamber further including a plurality of radioactive shielding partitions such that each of the plurality of radioactive shielding partitions is between adjacent cells and the cells comprise a docking cell having a disposition end of each transfer shaft connected thereto, and at least one assembly cell for constructing the one or more radioactive capsule therein; and at least one transfer shaft connecting the storage pool and the capsule assembly building to provide direct access to the storage pool from an interior of the capsule assembly building for transferring the radioisotopes from within the storage pool to the interior of the capsule assembly building and from the interior of the capsule assembly building into the storage pool, the at least one transfer shaft connected to a floor of the capsule assembly building.

10. The system of claim 9, wherein each transfer shaft comprises an elevator system operable to convey the radioisotopes from within the storage pool directly to an interior of the assembly chamber and from the interior of the assembly chamber into the storage pool.

11. The system of claim 9, wherein the shielding partitions are movable within the assembly chamber.

12. The system of claim 9, wherein the capsule assembly building further comprises a pair of opposing interlocks connected to opposing ends of the assembly chamber.

13. The system of claim 12, wherein the assembly building further comprises a crane device within the interior of the assembly chamber operable to move the radioisotopes over the shielding partitions between the plurality of cells and between the plurality of cells and the interlocks.

14. The system of claim 12, wherein the assembly building further comprises a conveyor system within or beneath a floor of the assembly chamber operable to move the radioisotopes beneath the shielding partitions between the plurality of cells and between the plurality of cells and the interlocks.

15. The system of claim 9, wherein at least one cell of the plurality of interior cells has opposing exterior walls, each of the opposing exterior walls of the at least one cell comprise at least one object manipulator opening that extends through the respective exterior wall, each object manipulator opening structured to allow access of a respective object manipulator to an interior of the cell, each object manipulator controllable from outside of the assembly chamber and operable to manipulate the radioactive objects within each of the cells to assemble the one or more radioactive articles.

16. The system of claim 9, further comprising a second capsule assembly building located above the storage pool and connected with the storage pool via at least one second transfer shaft for constructing one or more radioactive capsules using the radioisotopes transferred from the storage pool via the at least one second transfer shaft.

17. The system of claim 1, wherein the at least one transfer shaft is connected to a sidewall of the storage pool.

18. The system of claim 1, wherein a first aperture is provided in a sidewall of the storage pool, a second aperture is provided in the floor of the assembly building, and the at least one transfer shaft extends from the first aperture to the second aperture.

19. The system of claim 18, wherein the first aperture is lower than the second aperture.

20. The system of claim 1, wherein the at least one transfer shaft is directly connected to the floor of the assembly building via an aperture in the floor of the assembly building.

* * * * *